United States Patent [19]

Ishiguro et al.

[11] Patent Number: 4,581,322

[45] Date of Patent: Apr. 8, 1986

[54] IMAGE FORMING METHOD

[75] Inventors: Shoji Ishiguro; Hiroyuki Mifune; Morio Yagihara; Yoshio Inagaki, all of Kanagawa; Kanji Meguro, Hyogo, all of Japan

[73] Assignee: Fuji Photo Film Co., Ltd., Kanagawa, Japan

[21] Appl. No.: 681,762

[22] Filed: Dec. 14, 1984

[30] Foreign Application Priority Data

Dec. 16, 1983 [JP] Japan ..... 58-237317

[51] Int. Cl.[4] ..... G03C 5/30

[52] U.S. Cl. ..... 430/434; 430/445; 430/564; 430/599; 430/603; 430/607; 430/611

[58] Field of Search ..... 430/434, 564, 599, 603, 430/607, 611, 445, 393

[56] References Cited

U.S. PATENT DOCUMENTS 4,230,796 10/1980 Gunther et al. ..... 430/564

4,251,617 2/1981 Bloom et al. ..... 430/599

*Primary Examiner*—Mary F. Downey

*Attorney, Agent, or Firm*—Sughrue, Mion, Zinn, Macpeak and Seas

[57] ABSTRACT

A method for developing a silver halide photographic material in the presence of an amino compound represented by the following general formula (I) or the salt thereof to increase photographic speed and/or gamma without being attended by a concomitant increase in generation of fog:

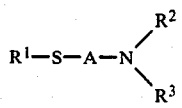

(I)

wherein $R^1$ represents an alkyl group, an aryl group, an aralkyl group or a cycloalkyl group; $R^2$ and $R^3$, which may be the same or different, each represents a hydrogen atom, an alkyl group, an alkenyl group, an aryl group, an aralkyl group or an alkylcarbonyl group, or $R^2$ and $R^3$ may combine with each other and form a ring; and A represents a divalent aliphatic linkage group.

19 Claims, No Drawings

IMAGE FORMING METHOD

FIELD OF THE INVENTION

The present invention relates to an image forming method of a silver halide photographic material and, more particularly, to a method of forming an image at a high photographic speed without a concomitant marked generation of fog in which a silver halide photographic material is development processed in the presence of a particular amino compound.

BACKGROUND OF THE INVENTION

For the purpose of increasing the photographic speed of a silver halide photographic material, various kinds of compounds have so far been examined.

In particular, it is well known that a certain amino compound, such as an alkylamine, ammonia, a hydroxyamine, a pyridine, an ethylenediamine, an imidazole, etc., is added to a silver halide photosensitive material or a developing solution in order to increase a photographic speed through acceleration of development. Details of effects brought about by such compounds are described in *Research Disclosure,* 17643, Vol. 176 (December, 1978); T. H. James, *The Theory of the Photographic Process,* 4th Ed., p. 424, Macmillan Publishing Inc. (1977), and so on.

However, although those amino compounds can increase the photographic speed through acceleration of development and so on, the methods suffer from the defect that fog density is considerably increased with the increase in photographic speed.

In addition, those amino compounds have little effect in rendering the gradation of a silver halide emulsion of high contrast.

SUMMARY OF THE INVENTION

Therefore, a primary object of the present invention is to provide a silver halide image with a high photographic speed without a concomitant marked generation of fog.

Another object of the present invention is to provide a silver halide image of high contrast with a high photographic speed.

The above-described objects of the present invention are attained by carrying out development processing in the presence of an amino compound represented by the following formula (I) or a salt formed from said amino compound and an inorganic acid or an organic acid (specifically by adding the amino compound to a silver halide photosensitive material and/or a developing solution or the prebath thereof):

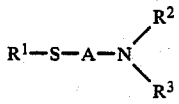

(I)

wherein $R^1$ represents an alkyl group, an aryl group, an aralkyl group or a cycloalkyl group; $R^2$ and $R^3$, which may be the same or different, each represents a hydrogen atom, an alkyl group, an alkenyl group, an aryl group, an aralkyl group or an alkylcarbonyl group, or $R^2$ and $R^3$ may combine with each other and form a ring; and A represents a divalent aliphatic linkage group.

DETAILED DESCRIPTION OF THE INVENTION

The $R^1$ in the amino compound of the present invention represented by the general formula (I) includes aryl groups (having not more than 20 carbon atoms in total, such as phenyl, naphthyl, etc.), aralkyl groups (having not more than 16 carbon atoms in total, such as benzyl, phenethyl, etc.), alkyl groups (having from 1 to 16 carbon atoms, in total, such as methyl, propyl, hexyl, octyl, etc.) and cycloalkyl groups (having not more than 10 carbon atoms in total, such as cyclohexyl, etc.), each of which may be substituted with one or more substituent groups.

Specific examples of the substituent groups with which the above-described groups representing $R^1$ may be substituted include halogen atoms (e.g., fluorine, chlorine, bromine, etc.), a cyano group, a nitro group, a hydroxyl group, a carboxyl group, a sulfo group, an alkyl group (e.g., methyl, ethyl, etc.), an aryl group (e.g., phenyl, tolyl, etc.), an alkoxy group (e.g., methoxy, ethoxy, etc.), an aryloxy group (e.g., phenoxy, etc.), an acyloxy group (e.g., acetoxy, etc.), an acylamino group (e.g., acetylamino, etc.), a sulfonamido group (e.g., methanesulfonamido, etc.), a sulfamoyl group (e.g., methylsulfamoyl, etc.), a carbamoyl group (e.g., carbamoyl, methylcarbamoyl, etc.), an alkoxycarbonyl group (e.g., methoxycarbonyl, ethoxycarbonyl, etc.), a sulfonyl group (e.g., methylsulfonyl, etc.), a sulfinyl group (e.g., methylsulfinyl, etc.), and an alkylthio group (e.g., methylthio, etc.).

Of the groups representing $R^1$, aryl groups and aralkyl groups are especially desirable, and halogen atoms, cyano groups and lower alkyl groups (having 1 to 6 carbon atoms) are preferred as substituents of these groups.

The $R^2$ and $R^3$ in the general formula (I) may be the same or different, and they each represents s hydrogen atom, an alkyl group (having 1 to 12 carbon atoms, e.g., methyl, ethyl, hydroxymethyl, hydroxyethyl, etc.), an alkenyl group (having up to 12 carbon atoms, e.g., allyl, etc.), an aryl group (having up to 20 carbon atoms, e.g., phenyl, etc.), an aralkyl group (having up to 16 carbon atoms, e.g., benzyl, etc.), and an alkylcarbonyl group (having up to 12 carbon atoms, e.g., acetyl, etc.). These groups may be substituted with the same substituents as those for $R^1$.

Further, the $R^2$ and $R^3$ may combine with each other and form a ring (e.g., 5-membered ring, 6-membered ring, etc.).

In a preferred case, either $R^2$ or $R^3$ is a hydrogen atom. Therein, it is particularly preferred that both $R^2$ and $R^3$ represent a hydrogen atom.

A in the general formula (I) represents a divalent aliphatic linkage group. Specific examples of the linkage group include straight or branched chain alkylene groups (preferably having not more than 12 carbon atoms), such as ethylene, propylene, trimethylene, ethylethylene, methyltrimethylene and so on. These linkage groups may be substituted with a phenyl group or the like.

On the other hand, the compound of the general formula (I) may be used in a form of salt produced by the reaction with an inorganic acid (e.g., hydrochloric acid, sulfuric acid, nitric acid, hydrobromic acid, perchloric acid, etc.), or an organic acid (e.g., acetic acid, oxalic acid, malonic acid, maleic acid, fumaric acid, malic acid, p-toluenesulfonic acid, etc.).

Specific examples of the compound represented by the general formula (I) which characterizes the present invention are illustrated below.

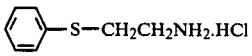
Compound 1

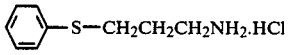
Compound 2

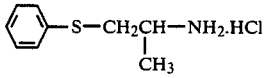
Compound 3

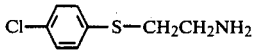
Compound 4

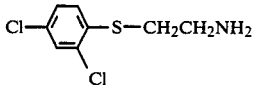
Compound 5

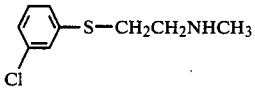
Compound 6

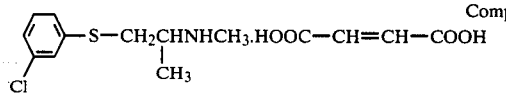
Compound 7

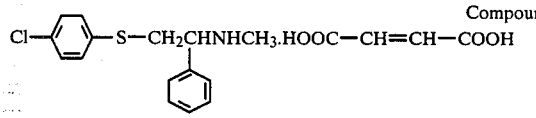
Compound 8

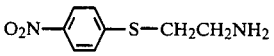
Compound 9

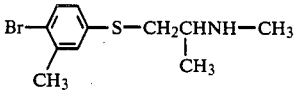
Compound 10

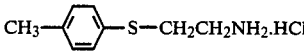
Compound 11

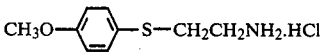
Compound 12

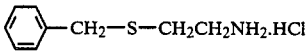
Compound 13

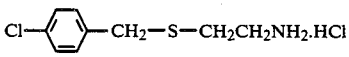
Compound 14

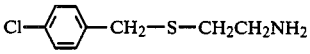
Compound 15

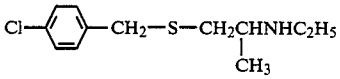
Compound 16

-continued

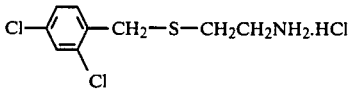
Compound 17

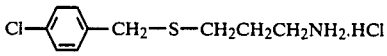
Compound 18

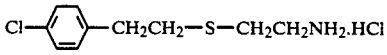
Compound 19

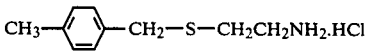
Compound 20

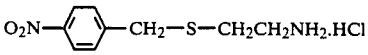
Compound 21

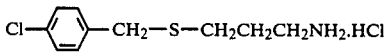
Compound 22

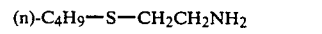
Compound 23

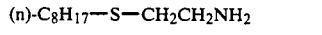
Compound 24

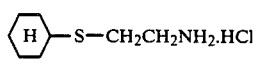
Compound 25

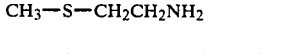
Compound 26

The compounds represented by the general formula (I) of the present invention can be generally synthesized using methods illustrated by the following general reaction schemes.

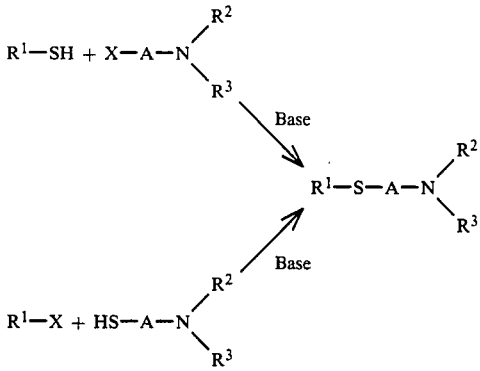

When A is a branched alkylene group, the compounds of the present invention can also be synthesized using the method illustrated by the following reaction scheme.

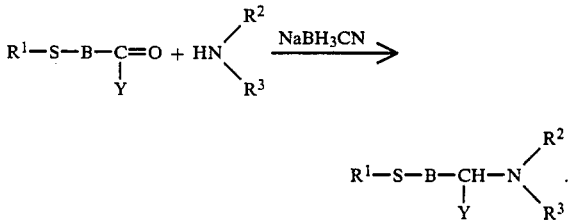

In the above reaction schemes, B represents an alkyl group containing carbon atoms the number of which is less than that of A by one or two (e.g., methylene, ethylene, propylene, etc.); Y represents an akyl group (e.g., methyl, ethyl, etc.), a phenyl group or so on; and $R^1$, $R^2$ and $R^3$ have the same meanings as in the general formula (I), respectively.

In a specified case of $R^2=R^3=H$, the compounds of the present invention may be synthesized using the method illustrated by the following reaction scheme.

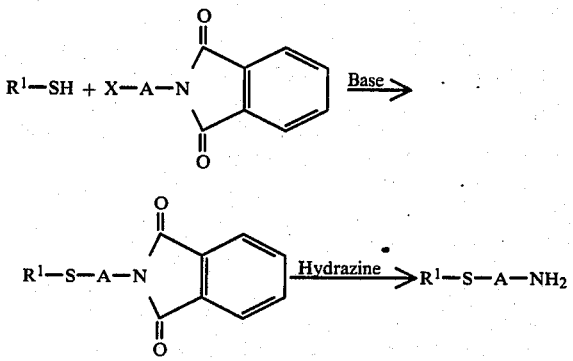

Further, when $R^2=R^3=H$ and $A=-CH_2CH_2-$, the compounds of the present invention may also be synthesized using the method illustrated by the following reaction scheme.

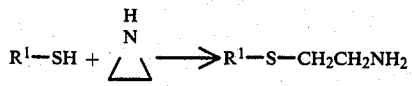

In the above reaction schemes, X represents a halogen atom, and $R^1$, $R^2$, $R^3$ and A have the same meanings as in the general formula (I), respectively.

Specific synthesis examples of the compounds of the present invention are illustrated in detail below.

SYNTHESIS EXAMPLE 1

Synthesis of Compound 13

A mixture composed of 12.4 g of benzyl mercaptan, 20.5 g of 2-bromoethylamine hydrobromide and 150 ml of methanol was cooled to −10° C. in a stream of nitrogen gas and thereto 40 ml of a 28% methanol solution of sodium methoxide was added while stirring. The resulting mixture was stirred further for 3 hours. Thereafter, methanol was distilled away, and the reaction product was converted to the hydrochloride by adding concentrated hydrochloric acid, and then the hydrochloride was concentrated under reduced pressure. Acetonitrile and ethyl acetate were added to the residue and the crystals separated out. The crystals were filtered off, washed with ethyl acetate, and recrystallized from acetonitrile. Yield 6.0 g, Melting Point 121° to 123° C.

SYNTHESIS EXAMPLE 2

Synthesis of Compound 15

A mixture composed of 25 g of p-chlorobenzyl mercaptan, 31.0 g of 2-bromoethylamine hydrobromide and 100 ml of methanol was cooled to −10° C. in a stream of nitrogen and thereto 63.2 ml of a 28% methanol solution of sodium methoxide was added dropwise as the resulting mixture was stirred and kept at a temperature of −10° C. Then, the stirring was further continued for 3 hours at room temperature. The insoluble material was removed by filtration and the filtrate was concentrated. To the residue, 50 ml of ethanol saturated with hydrogen chloride was added and stirred with cooling. Thereto, 20 ml of ethanol was further added. The solid thus deposited was recrystallized, and recovered by filtration. The crystals thus obtained were recrystallized again from acetonitrile. Yield 19.2 g, Melting Point 134° to 136° C.

SYNTHESIS EXAMPLE 3

Synthesis of Compound 18

A mixture composed of 25 g of p-chlorobenzyl mercaptan, 34.5 g of 3-bromopropylamine hydrobromide and 100 ml of methanol was cooled to −10° C. in a stream of nitrogen and thereto 63.2 ml of a 28% methanol solution of sodium methoxide was added dropwise as the resulting mixture was stirred and kept at a temperature of −10° C. Then, the mixture was warmed to room temperature, and the stirring was further continued for 3 hours. The precipitate thus generated was removed by filtration and the filtrate was concentrated. To the residue, 50 ml of ethanol saturated with hydrogen chloride was added and stirred with cooling. Thereto, 20 ml of ethanol was further added, and the solid thus deposited was recrystallized and recovered by filtration. The crystals thus obtained were further recrystallized from 390 ml of acetonitrile. Yield 22 g, Melting Point 100° to 101° C.

SYNTHESIS EXAMPLE 4

Synthesis of Compound 21

7.7 g of aminoethanethiol and 20 ml of a 28% methanol solution of sodium methoxide were added to 80 ml of methanol, and cooled to 0° C. in a stream of nitrogen. Thereto, 17.2 g of p-nitrobenzyl chloride dissolved in methanol was added as the resulting mixture was kept at a temperature of not higher than 10° C. The stirring was continued for 3 hours at room temperature and then the reaction mixture was poured into about 500 ml of water. The reaction product was extracted with ethyl acetate. After removal of ethyl acetate by evaporation under reduced pressure, a saturated ethanol solution of hydrogen chloride was added to the resulting extract. Thereto, ethyl acetate and hexane were further added, and the crystals thus precipitated were recovered by filtration and further recrystallized from a mixture of ethanol and methanol. Yield 5.4 g, Melting Point 205° to 207° C.

SYNTHESIS EXAMPLE 5

Synthesis of Compound 24

A mixture of 9.0 g of n-butyl mercaptan, 4.74 g of ethyleneimide and 100 ml of methanol was stirred for 4 hours in a cooled condition (10° to 20° C.). Thereafter, the precipitate thus produced was removed by filtration, and the filtrate was concentrated. The solid thus obtained was recrystallized from methanol. Yield 8.3 g, Melting Point 114° to 121° C.

SYNTHESIS EXAMPLE 6

Synthesis of Compound 25

A mixture composed of 11.6 g of cyclohexyl mercaptan, 20.5 g of 2-bromoethylamine hydrobromide and 150 ml of methanol was cooled to −10° C. in a stream of nitrogen and thereto 40 ml of a 28% methanol solution of sodium methoxide was added with stirring. The stirring was continued for additional 3 hours at room temperature. Thereafter, the reaction mixture was poured into about 500 ml of water, and the reaction product was extracted with ethyl acetate. After removal of ethyl acetate by evaporation under reduced pressure, an excess amount of concentrated hydrochloric acid was added to the extract. The reaction mixture was concentrated under reduced pressure and cooled in an ice bath. The crystals thus precipitated were filtered off, washed with ethyl acetate, and recrystallized from the ethyl acetateacetonitrile (1:1 by volume) mixture. Yield 5.4 g, Melting Point 210° C.

In accordance with the present invention, it has been found that development carried out in the presence of the amino compounds having the general formula (I) illustrated hereinbefore can contribute to considerable reduction of fog density and to remarkable increase in photographic speed, compared with conventional amino compounds which have so far been employed as a development accelerator. It has further been found in accordance with the present invention that the compounds of the present invention can bring about a marked increase in gradient under certain circumstances.

The compound of the present invention can be incorporated in any one of silver halide emulsion layers or other hydrophilic colloidal layers which construct a photographic material. More specifically, it may be incorporated in a photographic emulsion layer or a light-insensitive layer such as a protective layer, an interlayer, a filter layer, an antihalation layer or so on. In particular, incorporation into a silver halide photographic emulsion layer is desirable.

The compound of the present invention can usually provide a good result when used in an amount ranging from about $1\times10^{-5}$ to about $5\times10^{-2}$ mol, particularly from $5\times10^{-5}$ to $2\times10^{-2}$ mol, per mol of silver halide.

In adding the compound of the present invention to a photographic material, usual methods for adding additives to a photographic emulsion can be employed. For instance, if it is soluble in water, the compound to be added is first dissolved in water in a proper concentration and then added to an emulsion. On the other hand, if it is insoluble or slightly soluble in water, the compound is first dissolved in a proper organic solvent which is miscible with water and has no bad influences upon photographic characteristics, for example, an organic solvent selected from alcohols, ethers, glycols, ketones, esters, amides or the like, and the resulting solution is added to an emulsion. Moreover, a well-known method which has been used for adding a water-insoluble (the so-called oil-soluble) coupler to an emulsion in the form of a dispersion can also be employed.

In addition, the compound of the present invention can be contained in a processing solution such as a developing solution, a prebath thereof or the like. In general, it is desirable to add the compound of the present invention in an amount of about $1\times10^{-4}$ to about $5\times10^{-2}$ mol/l, particularly preferably $2\times10^{-4}$ to $2\times10^{-2}$ mol/l.

Suitable examples of silver halide which is present in a silver halide photosensitive material usable in the present invention include silver chloride, silver chlorobromide, silver bromide, silver iodobromide and silver iodochlorobromide. A mean size of the silver halide grains is, though subject to no particular restriction, preferably not larger than $3\mu$.

The grain size distribution of the silver halide grains may be narrow or broad.

The silver halide grains in the photographic emulsions of the present invention may have a regular crystal form, such as that of a cube or an octahedron; an irregular crystal form, such as that of a sphere, a tabular or so on; or a composite form thereof. A mixture of various crystal forms of silver halide grains may also be used.

The interior and the surface of the silver halide grains may differ, or the silver halide grains may be uniform throughout. Further, silver halide grains of the kind which form a latent image predominantly at the surface of the grains, or silver halide grains of the kind which mainly form a latent image inside the grains may be used.

The photographic emulsions used in the present invention can be prepared using various methods as described in, for example, P. Glafkides, *Chimie et Physique Photographique,* Paul Montel, Paris (1967), G. F. Duffin, *Photographic Emulsion Chemistry,* The Focal Press, London (1966), and V. L. Zelikman et al., *Making and Coating Photographic Emulsion,* The Focal Press, London (1964). Specifically, the acid process, the neutral process, the ammonia process and any other process can be employed. Suitable methods for reacting a water-soluble silver salt with a water-soluble halide include, e.g., a single jet method, a double jet method, a combination thereof, and so on.

Also, a method in which silver halide grains are produced in the presence of excess silver ion (the so-called reversal mixing method) can be employed in the present invention. On the other hand, the so-called controlled double jet method, in which the pAg of the liquid phase in which silver halide grains are to be precipitated is maintained constant, may be also employed in the present invention.

According to this method, a silver halide emulsion in which grains having a regular crystal form and being almost uniform in size are present can be obtained.

Two or more kinds of silver halide emulsions prepared separately may be used in the form of a mixture.

In a process of producing silver halide grains or allowing the produced silver halide grains to ripen physically, cadmium salts, zinc salts, lead salts, thallium salts, iridium salts or complexes, rhodium salts or complexes, iron salts or complexes and/or the like may be present.

The silver halide emulsion can be a so-called un-after-ripened emulsion (e.g., a primitive emulsion), that is to say, a chemically unsensitized emulsion. However, it is generally chemically sensitized. Chemical sensitization can be carried out using processes described in P. Glafkides, supra, V. L. Zelikman et al, supra, or H. Frieser, *Die Grundlagen der Photographischen Prozesse mit Silberhalogeniden,* Akademische Verlagsgesellschaft (1968).

More specifically, sulfur sensitization using compounds such as thiosulfates, thioureas, thiazoles, rhodanines, etc., or active gelatin; reduction sensitization using stannous salts, amines, hydrazines, formamidine sulfinic acid, silane compounds and the like; noble metal sensitization using gold complexes and Group VIII metal complexes such as those of platinum, iridium, palladium, etc.; and so on can be employed independently or in combination of two or more.

In order to increase photographic speed, increase contrast, or increase acceleration of development, the photographic emulsion may contain, e.g., polyalkylene oxides or derivatives thereof such as ethers thereof, esters thereof, amines thereof, etc.; thioether compounds; thiomorpholines; quaternary ammonium salts; urethane derivatives; urea derivatives; imidazole derivatives; 3-pyrazolidone derivatives; and so on. Specifically, those described in, e.g., U.S. Pat. Nos. 2,400,532, 2,423,549, 2,716,062, 3,617,280, 3,772,021 and 3,808,003; and so on can be used for the above-described purposes.

The photosensitive material can contain a wide variety of compounds for purposes of preventing fogging or stabilizing photographic functions during production, storage or photographic processing. More specifically, a great number of compounds which have been well-known as an antifoggant or a stabilizer, such as azoles including benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole) and the like; mercaptopyrimidines; mercaptotriazines; thioketo compounds like oxazolinethione; azaindenes including triazaindenes, tetraazaindenes (especially 4-hydroxy-6-methyl(1,3,3a,7)tetraazaindene), pentaazaindenes and the like; benzenesulfinic acid; benzenesulfonic acid amide; and so on, can be added.

In the present invention, gelatin is used to advantage as a binder or a protective colloid of photographic emulsions. However, hydrophilic colloids other than gelatin can also be used.

Specific examples of such hydrophilic colloids include proteins such as gelatin derivatives, graft polymers prepared from gelatin and other high polymers, albumin, casein, etc.; sugar derivatives, e.g., cellulose derivatives such as hydroxyethyl cellulose, carboxymethyl cellulose, cellulose sulfate and the like, sodium alginate, starch derivatives, and so on; and synthetic hydrophilic macromolecular substances such as homo- or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

Suitable gelatin may be not only lime-processed gelatin but also acid-processed gelatin. Further, hydrolysis products of gelatin and enzymatic degradation products of gelatin may also be used.

The photographic emulsion layers and other hydrophilic colloid layers may contain various kinds of surface active agents as a coating aid and for other purposes, for example, prevention from the generation of static charges, improvement in slipping facility, emulsifying dispersion, prevention from generation of adhesion, improvement in the photographic characteristics (e.g., acceleration of development, increase in gradient, sensitization, etc.) and so on Examples of suitable surface active agents include nonionic surface active agents such as saponin, alkylene oxide derivatives (e.g., polyethylene glycols, polyalkylene glycol alkylamines or amides, polyethylene oxide adducts of silicones, etc.), glycidol derivatives (e.g., alkenylsuccinic acid polyglyceride, etc.), fatty acid esters of polyhydric alcohols, alkyl esters of sugars, urethanes or ethers of sugars, and so on; anionic surface active agents such as triterpenoid type saponin, alkylcarboxylates, alkylbenzenesulfonates, alkylsulfates, alkyl phosphates, N-acyl-N-alkyltaurines, sulfosuccinic acid esters, sulfoalkylpolyoxyethylenealkylphenyl ethers, and so on; amphoteric surface active agents such as amino acids, aminoalkylsulfonates, aminoalkyl sulfates or phosphates, alkyl betaines, amineimides, amine oxides, and so on; and cationic surface active agents such as alkylamine salts, aliphatic or aromatic quaternary ammonium salts, heterocyclic quaternary ammonium salts (e.g., pyridinium, imidazolium, etc.), aliphatic or hetero ring-containing phosphonium or sulfonium salts, and so on.

In the photographic material of the present invention, the photographic emulsion layers and other hydrophilic colloid layers can contain a dispersion of water-insoluble or slightly soluble synthetic polymer for the purpose of improvement in dimensional stability and so on. Suitable examples of such synthetic polymers include those containing as their constituent monomers, e.g., alkyl(meth)acrylate, alkoxyalkyl(meth)acrylate, glycidyl(meth)acrylate, (meth)acrylamide, vinyl ester (e.g., vinyl acetate), acrylonitrile, olefin, styrene and the like independently or in combination of two or more, or a combination of one or more of a monomers selected from the above-described monomers with acrylic acid, methacrylic acid, $\alpha,\beta$-unsaturated dicarboxylic acid, hydroxyalkyl(meth)acrylate, sulfoalkyl(meth)acrylate, styrenesulfonic acid or so on.

In the photographic material of the present invention, the photographic emulsion layers and other hydrophilic colloid layers may contain an inorganic or organic hardener. For example, chromium salts (e.g., chrome alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, bis(vinylsulfonyl)methylether, etc.), active halogen-containing compounds (e.g., 2,4-dichloro-6-hydroxy-s-triazine, etc.), mucochloric acids (e.g., mucochloric acid, mucophenoxychloric acid, etc.), isooxazoles, dialdehyde starch, 2-chloro-6-hydroxytriazinylated gelatin and so on can be used independently or in combination of two or more thereof.

The photographic emulsions of the present invention may be spectrally sensitized using methine dyes or other dyes. Suitable spectral sensitizing dyes include cyanine dyes, merocyanine dyes, complex cyanine dyes, complex merocyanine dyes, holopolar cyanine dyes, hemicyanine dyes, styryl dyes and hemioxonol dyes. Especially useful dyes are merocyanine dyes and complex merocyanine dyes. Any nuclei usually present in cyanine dyes can be the basic heterocyclic nuclei of these dyes. More specifically, the basic heterocyclic nuclei include pyrroline, oxazoline, thiazoline, pyrrole, oxazole, thiazole, selenazole, imidazole, tetrazole, pyridine and like nuclei; nuclei formed by fusing together one of the above-described nuclei and an alicyclic hydrocarbon ring; and nuclei formed by fusing together one of the above-described nuclei and an aromatic hydrocarbon ring, with specific examples including indolenine, benzindolenine, indole, benzoxazole, naphthoxazole, benzothiazole, naphthothiazole, benzoselenazole, benzimidazole, quinoline and like nuclei. Each of these nuclei may also be substituted on the carbon atoms.

The merocyanine and complex merocyanine dyes can contain 5- or 6-membered heterocyclic nuclei such as pyrazoline-5-one, thiohydantoin, 2-thiooxazolidine-2,4-dione, thiazolidine-2,4-dione, rhodanine, thiobarbituric acid and like nuclei, as ketomethylene structure-containing nuclei.

In the photosensitive material of the present invention, the hydrophilic colloid layers may contain water-soluble dyes (such as oxonol dyes, hemioxonol dyes, styryl dyes, merocyanine dyes, cyanine dyes, azo dyes and so on) as a filter dye or an antihalation dye, and for other various purposes.

The photographic emulsions of the present invention may contain color image-forming couplers, that is, compounds capable of forming dyes by reacting with oxidation products of aromatic amine (usually primary amine) developing agents (which compounds are abbreviated as "couplers" hereinafter). Preferred couplers are nondiffusible ones having a hydrophobic group called a ballast group in their molecular structure. The couplers may be either 4-equivalent or 2-equivalent to silver ion. Further, the couplers may include colored couplers having a color correction effect, or couplers capable of releasing development inhibitors upon development (so-called DIR couplers). In addition, the couplers may be such couplers as to produce colorless compounds by the coupling reaction.

Known open-chain ketomethylene type couplers can be employed as yellow couplers. Of these couplers, benzoylacetanilide compounds and pivaloylacetanilide compounds are of greater advantage.

Pyrazolone compounds, indazolone compounds, cyanoacetyl compounds and the like can be employed as magenta couplers. Of these compounds, pyrazolone compounds are particularly advantageous.

Phenol and naphthol derivatives are mainly employed as cyan couplers.

DIR couplers which can be used include those described in, e.g., U.S. Pat. Nos. 3,227,554, 3,617,291, 3,701,783, 3,790,384 and 3,632,345, German Patent Application (OLS) Nos. 2,414,006, 2,454,301 and 2,454,329, British Pat. No. 953,454, and U.S. Pat. No. 4,149,886.

In addition to DIR couplers, compounds capable of releasing development inhibitors upon development may be incorporated in the photosensitive material, and specific examples thereof include those described in U.S. Pat. Nos. 3,297,445 and 3,379,529, and German Patent Application (OLS) No. 2,417,914.

Two or more of the above-described couplers may be incorporated in the same layer, or one of the above-described couplers may be incorporated in two or more of different layers.

The photosensitive material produced in accordance with an embodiment of the present invention may contain hydroquinone derivatives, aminophenol derivatives, gallic acid derivatives, ascorbic acid derivatives or the like as a color fog inhibitor.

The photosensitive material produced in accordance with an embodiment of the present invention may contain an ultraviolet absorbing agent such as benzotriazole compounds substituted with aryl groups in a hydrophilic colloid layer.

The photographic emulsions of the present invention are coated on a flexible support such as commonly used plastic films (e.g., cellulose nitrate, cellulose acetate, polyethylene terephthalate and like films), paper or so on, or a rigid support such as glass, etc.

The photographic material of the present invention can be employed for a wide variety of both color and monochromatic silver halide photosensitive materials. More specifically, such photosensitive materials include, for example, color positive, color papers, color negative, reversal color films (with or without couplers), photographic materials for the graphic arts (e.g., lith films), photosensitive materials for recording cathode ray tube displays, photosensitive material for recording X-rays (particularly direct and indirect materials using a fluorescent screen), photosensitive materials for the colloid transfer process, photosensitive materials for the silver salt diffusion transfer process, photosensitive materials for the dye transfer process, photosensitive materials for the silver dye bleaching method, photosensitive materials for recording printout images, heat developable photosensitive materials and so on.

The present invention can also be applied to multilayer multicolor photographic materials having on a support at least two layers differing in spectral sensitivity. The multilayer color photographic material usually has on a support at least one red-sensitive emulsion layer, at least one green-sensitive emulsion layer and at least one blue-sensitive emulsion layer. These emulsion layers may be arranged in any order as occasion calls. In general, the red-sensitive emulsion layer contains a cyan-forming coupler, the green-sensitive emulsion layer contains a magenta-forming coupler, and the blue-sensitive emulsion layer contains a yellow-forming coupler. According to circumstances, different combinations may be employed.

The exposure for obtaining a photographic image in the present invention may be carried out in a conventional manner. Any various known light sources including natural light (sunlight), a tungsten lamp, a fluorescent lamp, a mercury lamp, a xenon arc lamp, a carbon arc lamp, a xenon flash lamp, cathode ray tube flying spot and so on can be employed for the exposure. Suitable exposure times which can be used include not only exposure times commonly used in cameras ranging from about 1/1,000 to about 1 sec, but also exposure times shorter than 1/1,000 sec, for example, about $1/10^4$ to about $1/10^6$ sec as used with xenon flash lamps and cathode ray tubes. Exposure times longer than 1 sec can also be used.

Any known photographic processing methods can be employed for the photosensitive material of the present invention. Any known processing solutions can be employed in the present invention. The processing temperature is generally in the range of about 18° C. to about 50° C. Of course, temperatures higher than about 50° C. or lower than about 18° C. may be employed. This photographic processing may be either a photographic processing for forming a silver image (black-and-white photographic processing) or a photographic processing for forming a dye image (color photographic processing), depending upon the end-use purpose of the photographic material.

The developing solution employed for black-and-white photographic processing can contain known developing agents. Suitable developing agents include dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, heterocyclic compounds described in U.S. Pat. No. 4,067,872, which are compounds wherein 1,2,3,4-tetrahydroquinoline ring and indolenine ring may be condensed together, and so on. These compounds can be used alone or in combination. The developing solution can generally contain, in addition to the above-described developing agents, known preservatives, alkali agents, pH buffering agents and antifoggants and optionally the developing solution may contain dissolving aids, color toning agents, development accelerators, surface active agents, defoaming agents, water softeners, hardeners, viscosity imparting agents and so on.

Fixing solutions which can be used in the present invention are those having generally used compositions. Suitable fixing agents which can be used include not only thiosulfates and thiocyanates, but also organic sulfur-containing compounds which have so far been known to have fixing effects. The fixing solution may contain a water-soluble aluminum salt as a hardener.

General processes for forming dye images can be employed in the present invention also. For example, the negative-positive process (described in, e.g., *Journal of the Society of Motion Picture and Television Engineers*, Vol. 61, pp. 667–701 (1953)); the color reversal process in which a negative silver image is formed by development with a developing solution containing a black-and-white developing agent and then uniform exposure or another appropriate fogging treatment is carried out at least once, followed by color development to produce a positive dye image; the silver dye bleaching process in which photographic emulsion layers of incorporated coupler type are exposed to light and then developed to form silver images, and using the resulting silver images as a bleaching catalyst the dyes are bleached; and so on can be employed.

A color developing solution is, in general, an alkaline aqueous solution containing a color developing agent. Suitable examples of color developing agents which can be used include known aromatic primary amine developers, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.).

In addition to the above-described color developing agents, those described in L. F. A. Mason, *Photographic Processing Chemistry*, pp. 226–229, Focal Press, London (1966), U.S. Pat. Nos. 2,193,015 and 2,592,364, Japanese Patent Application (OPI) No. 64933/73 (the term "OPI" as used herein refers to a "published unexamined Japanese patent application"), and so on can also be used.

In addition, the color developing solution can contain a pH buffering agent such as sulfites, carbonates, borates or phosphates of alkali metals, a development inhibitor or an antifoggant such as a bromide, an iodide or an organic antifoggant, and so on. Optionally, the color developing solution may further contain a water softener, a preservative like a hydroxyamine, an organic solvent such as benzyl alcohol, diethylene glycol, etc., a development accelerator such as polyethylene glycol, a quaternary ammonium salt, an amine, etc., dye-forming couplers, competing couplers, a fogging agent like sodium borohydride, an auxiliary developer like 1-phenyl-3-pyrazolidone, a viscosity imparting agent, a polycarboxylic acid type chelating agent described in U.S. Pat. No. 4,083,723, an antioxidant described in German Patent Application (OLS) No. 2,622,950, and so on.

Photographic emulsion layers which have been color development processed are generally subjected to a bleach processing. The bleach processing may be carried out either simultaneously with or separately from a fix processing. Suitable examples of bleaching agents which can be used include compounds of polyvalent metals such as Fe (III), Co (III), Cr (VI), Cu (II), etc., peroxy acids, quinones, nitroso compounds and so on. More specifically, ferricyanides; dichromates; organic complex salts of Fe (III) or Co (III) with organic acids such as aminopolycarboxylic acids, e.g., ethylenediaminetetraacetic acid, nitrilotriacetic acid, 1,3-diamino-2-propanoltetraacetic acid and the like, citric acid, tartaric acid, amlic acid and so on; persulfates; permanganates; nitrosophenol; and so on. Of these compounds, potassium ferricyanide, sodium ethylenediaminetetraacetatoferrate (III) and ammonium ethylenediaminetetraacetatoferrate (III) are particularly useful. Ethylenediaminetetraacetatoiron (III) complex salts are useful in both independent bleaching solution and combined bleaching-fixing bath (blix bath).

To a bleaching or bleach-fix bath may be added bleach accelerators described in U.S. Pat. Nos. 3,042,520 and 3,241,966, Japanese Patent Publication Nos. 8506/70 and 8836/70, and so on; thiol compounds described in Japanese Patent Application (OPI) No. 65732/78; and other various additives.

The present invention is illustrated in greater detail by reference to the following examples, but does not limit the scope of the present invention thereto. Unless otherwise indicated, all ratios, percentages, etc., are by weight.

EXAMPLE 1

To a silver iodobromide-gelatin emulsion containing 6 mol% of silver iodide (grain size: about 0.75μ) were added 5 mg of sodium thiosulfate, 3.5 mg of potassium chloroaurate and 0.18 g of ammonium rhodanide per 1 mol of silver halide. The resulting emulsion was ripened at 60° C. for 50 minutes.

The thus chemically ripened emulsion was divided into 11 fractions and thereto the compounds of the present invention set forth in Table 1 or comparative compounds illustrated below were added separately and, at the same time, a hardener (sodium salt of 2,4-dichloro-6-hydroxy-1,3,5-triazine) and a coating aid (sodium dodecylbenzenesulfonate) were also added. Each of the fractions was coated on a triacetate film, and dried to prepare a sample.

Each of the samples was exposed to light for 1/100 sec through an optical wedge, and developed with the developer of Kodak D-72 at 20° C. for 4 minutes, followed by conventional fixing, washing and drying processings, in this order.

| D-72 Developer | |
|---|---|
| p-Methylaminophenol Sulfate | 3.1 g |
| Sodium Sulfite | 45.0 g |
| Hydroquinone | 12.0 g |
| Sodium Carbonate (monohydrate) | 79.0 g |
| Potassium Bromide | 1.9 g |
| Water to make | 1 liter |

The results obtained are shown in Table 1.

TABLE 1

| Sample No. | Compound | Amount Added (mol/mol Ag) | Relative Sensitivity | Fog |
|---|---|---|---|---|
| 1 | — | — | 100 | 0.04 |
| 2 | Compound 1 | $54 \times 10^{-4}$ | 151 | 0.04 |
| 3 | Compound 1 | $108 \times 10^{-4}$ | 182 | 0.06 |
| 4 | Compound 4 | $27 \times 10^{-4}$ | 132 | 0.04 |
| 5 | Compound 9 | $36 \times 10^{-4}$ | 129 | 0.04 |
| 6 | Compound 13 | $4.5 \times 10^{-4}$ | 141 | 0.04 |
| 7 | Compound 14 | $0.9 \times 10^{-4}$ | 120 | 0.04 |
| 8 | Compound 25 | $4.5 \times 10^{-4}$ | 135 | 0.05 |
| 9 | Comparative Compound A | $5.4 \times 10^{-4}$ | 129 | 0.08 |
| 10 | Comparative Compound B | $5.4 \times 10^{-4}$ | 135 | 0.13 |

TABLE 1-continued

| Sample No. | Compound | Amount Added (mol/mol Ag) | Relative Sensitivity | Fog |
|---|---|---|---|---|
| 11 | Comparative Compound C | $4.5 \times 10^{-4}$ | 135 | 0.10 |

The comparative compounds used herein are illustrated below.

Comparative Compound A

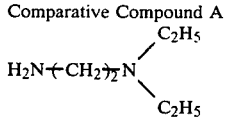

Comparative Compound B

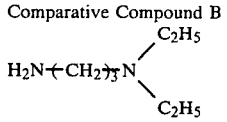

Comparative Compound C $H_2N(CH_2)_2S(CH_2)_2S(CH_2)_2NH_2.2HCl$

Photographic sensitivity is represented by the reciprocal of the exposure required for obtaining optical density of fog+0.2, and sensitivities of the sample in Table 1 are shown as relative values of Sample No. 1 as 100.

As can be seen from the data in Table 1, the presence of the compounds of the present invention (Sample No. 2 to Sample No. 8) brought about an increase in sensitivity. In addition, it can be seen from the comparison with the comparative compounds that the compounds of the present invention caused a slight increase in fog density in contrast to considerable increase in sensitivity.

EXAMPLE 2

The same sample as called No. 1 in Example 1 was exposed to light in the same manner as in Example 1. Thereafter, it was divided into 9 fractions. These fractions were developed at 20° C. for 4 minutes using different developing solutions separately, which were prepared by adding the compounds of the present invention or the comparative compounds set forth in Table 2 respectively to a Developer (I) having the following composition, followed by conventional fixing, washing and drying processings, in this order.

| Developer (I) | |
|---|---|
| Sodium Sulfite | 67 g |
| Hydroquinone | 23 g |
| 1-Phenyl-3-pyrazolidone | 0.4 g |
| Sodium Hydroxide | 11 g |
| Sodium Carbonate (monohydrate) | 11 g |
| Potassium Bromide | 3 g |
| 5-Methylbenzotriazole | 0.08 g |
| Water to make | 1 liter |
| pH, adjust to | 10.65 |

It is readily apparent from Table 2 that sensitivity and/or gamma was increased without a concomitant increase in fog density by the presence of the compounds of the present invention (in Samples No. 22 to No. 26).

Photographic sensitivity is represented by the reciprocal of the exposure required for obtaining optical density of fog+0.2, and sensitivities of the samples in Table 2 are shown as relative values of Sample No. 21 as 100.

Also in Table 2, $\gamma$ (gradient) is represented by tan $\theta$ which is the slope of the straight line connecting the point corresponding to the optical density of fog+0.2 on the characteristic curve and the point of the optical density obtained by the ten-fold exposure.

TABLE 2

| Sample No. | Compound | Amount Added (mol/l) | Relative Sensitivity | $\gamma$ | Fog |
|---|---|---|---|---|---|
| 21 | — | — | 100 | 0.62 | 0.04 |
| 22 | Compound 1 | $1.8 \times 10^{-3}$ | 182 | 0.65 | 0.05 |
| 23 | Compound 6 | " | 123 | 0.83 | 0.04 |
| 24 | Compound 7 | " | 105 | 0.87 | 0.03 |
| 25 | Compound 9 | " | 158 | 0.76 | 0.03 |
| 26 | Compound 14 | $3 \times 10^{-4}$ | 195 | 0.96 | 0.05 |
| 27 | Comparative Compound D | $1.8 \times 10^{-3}$ | 158 | 0.54 | 0.10 |
| 28 | Comparative Compound E | $3 \times 10^{-4}$ | 162 | 0.65 | 0.12 |
| 29 | Comparative Compound F | " | 120 | 0.60 | 0.06 |

The comparative compounds used herein are illustrated below.

Comparative Compound D $HO(CH_2)_2S(CH_2)_2S(CH_2)_2OH$

Comparative Compound E $H_2N(CH_2)_2S(CH_2)_2S(CH_2)_2NH_2.2HCl$

Comparative Compound F

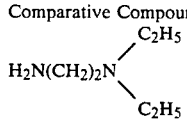

EXAMPLE 3

A silver halide emulsion comprising 83 mol% of silver chloride, 16.5 mol% of silver bromide and 0.5 mol% of silver iodide was subjected to gold sensitization and sulfur sensitization. The mean grain size of the silver halide grains contained in the emulsion was about 0.25$\mu$.

To the emulsion thus sensitized were successively added 3-ethyl-5-[2-(3-ethyl-2(3H)thiazolinidineethylidene]rhodanine, a polyalkylene oxide compound

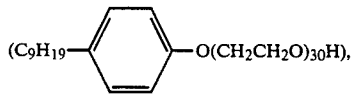

4-hydroxy-6-methyl-1,3,3a,7-tetraazaindene, sodium dodecylbenzenesulfonate, sodium salt of 2-hydroxy-4,6-dichloro-1,3,5-triazine, and a dispersion of polyethylacrylate. The resulting emulsion was coated on polyethylene terephthalate film bases.

The films thus prepared were exposed to light for 10 sec through a continuous wedge and thereafter developed at 38° C. for 20 sec using different kinds of developing solutions separately, which developing solutions had been prepared by adding the compounds of the present invention or the comparative compound respectively, which are set forth in Table 3, to separate fractions of a developer having the same composition as the Developer (I) used in Example 2. The developed films were fixed, washed with water and dried in conventional manners.

It can be readily seen from the data of Table 3 that remarkable increases in sensitivity and $\gamma$ (gradient) were achieved by carrying out photographic processing in the presence of the compounds of the present invention (Sample Nos. 32 to 39).

Photographic sensitivity is represented by the reciprocal of the exposure required for obtaining optical density of 3.0, and sensitivities of the samples in Table 3 are shown as relative values of Sample No. 31 as 100. On the other hand, gamma is represented by tan $\theta$ which is the slope of the straight line connecting the point corresponding to the optical density of fog+0.3 and the point corresponding to the optical density of fog+3.0.

TABLE 3

| Sample No. | Compound | Amount Added (mol/l) | Relative Sensitivity | $\gamma$ |
|---|---|---|---|---|
| 31 | — | — | 100 | 3.5 |
| 32 | Compound 4 | 0.001 | 115 | 4.2 |
| 33 | Compound 4 | 0.01 | 142 | 7.8 |
| 34 | Compound 7 | 0.01 | 120 | 3.5 |
| 35 | Compound 14 | 0.0005 | 120 | 5.0 |
| 36 | Compound 14 | 0.001 | 145 | 8.0 |
| 37 | Compound 23 | 0.005 | 132 | 4.0 |
| 38 | Compound 25 | 0.001 | 117 | 4.5 |
| 39 | Compound 25 | 0.005 | 132 | 7.6 |
| 40 | Comparative Compound G | 0.0005 | 120 | 3.0 |

The comparative compound used herein is illustrated below.

Comparative Compound G $$HO-CH_2-CH_2-S-CH_2-CH_2-S-CH_2-CH_2-OH$$

EXAMPLE 4

Photographic films were prepared in the same manner as employed in Example 3 except that the halide composition of the silver halide emulsion was 70 mol% chloride and 30 mol% bromide, and the mean grain size of the silver halide grains was 0.33$\mu$.

These films were exposed to light for 10 seconds through a continuous wedge. Thereafter, they were developed at 20° C. for 2 minutes using different developing solutions separately, which developing solutions had been prepared by adding the compounds of the present invention or the comparative compound respectively, which are set forth in Table 4, to separate fractions of a developing solution having the same composition as the Developer (I) used in Example 2. The developed films were fixed, washed with water and dried in conventional manners.

It is readily apparent from the data in Table 4 that both sensitivity and gamma (gradient) were increased by development processing in the presence of the compounds of the present invention.

Photographic sensitivity is represented by the reciprocal of the exposure required for obtaining optical density of 3.0, and sensitivities of the samples in Table 4 are shown as relative values of Sample No. 41 as 100.

Gamma is represented by tan $\theta$ which is the slope of the straight line connecting the point corresponding to the optical density of fog+0.3 and the point corresponding to the optical density of fog+3.0.

TABLE 4

| Sample No. | Compound | Amount Added (mol/l) | Relative Sensitivity | $\gamma$ |
|---|---|---|---|---|
| 41 | — | — | 100 | 3.3 |
| 42 | Compound 1 | 0.0033 | 316 | 4.1 |
| 43 | Compound 4 | 0.0033 | 135 | 6.0 |
| 44 | Compound 14 | 0.0010 | 126 | 6.4 |
| 45 | Compound 22 | 0.0010 | 170 | 5.4 |
| 46 | Comparative Compound H | 0.0010 | 170 | 2.2 |

The comparative compound used herein is illustrated below.

Comparative Compound H $$HO(CH_2)_2S(CH_2)_2S(CH_2)_2OH$$

EXAMPLE 5

A silver chlorobromide emulsion containing rhodium and having a mean grain size of 0.3$\mu$ was prepared. Soluble salts were removed from the emulsion in a conventional manner. Then, the desalted emulsion was chemically ripened by adding sodium thiosulfate and potassium chloroaurate thereto. This emulsion contained 70 mol% of silver chloride, 30 mol% of silver bromide and $5\times10^{-6}$ mol/mol silver of rhodium.

To the emulsion were added successively 3-ethyl-5-[2-(3-ethyl-2(3H)thiazolinidene-ethylidene]rhodanine, 5-methylbenzotriazole, a polyalkylene oxide compound having the formula,

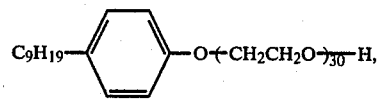

4-hydroxy-6-methyl-1,3,3a,7-tetraazaindene, sodium dodecylbenzenesulfonate, the sodium salt of 2-hydroxy-4,6-dichloro-1,3,5-triazine, and a dispersion of polyethylacrylate. The resulting emulsion was coated on polyethylene terephthalate film bases at the same coverage of 4 g/m$^2$ based on silver.

The films thus prepared were exposed to light for 10 sec through a continuous wedge. After exposure, they were developed at 38° C. for 20 sec using different developing solutions separately, which developing solutions had been prepared by adding the compounds of the present invention or the comparative compound respectively, which are set forth in Table 5, to separate fractions of Developer (II) having the composition set forth below. The developed films were fised, washed with water and dried in conventional manners. The results obtained are shown in Table 5.

Photographic sensitivity is represented by the reciprocal of the exposure required for obtaining optical density of 3.0, and sensitivities of the samples in Table 5 are shown as relative values of Sample No. 51 as 100. Gamma is represented by tan $\theta$ which is the slope of the straight line connecting the point corresponding to the optical density of fog+0.3 and the point corresponding to the optical density of fog+3.0.

| Developer (II) | |
|---|---|
| Sodium Sulfite | 67 g |
| Hydroquinone | 23 g |
| 1-Phenyl-3-pyrazolidone | 0.4 g |
| Potassium Hydroxide | 11 g |

-continued

| Developer (II) | |
|---|---|
| Sodium Carbonate (monohydrate) | 11 g |
| Potassium Bromide | 3 g |
| 5-Nitroindazole | 0.08 g |
| Water to make | 1 liter |

It is readily apparent from Table 5 that the sensitivity and/or gamma (gradient) was remarkably increased by processing in the presence of the compounds of the present invention (Sample Nos. 52 to 57).

TABLE 5

| Sample No. | Compound | Amount Added (mol/l) | Relative Sensitivity | γ |
|---|---|---|---|---|
| 51 | — | — | 100 | 6.0 |
| 52 | Compound 3 | 0.005 | 140 | 10.0 |
| 53 | Compound 4 | 0.0033 | 140 | 11.0 |
| 54 | Compound 4 | 0.01 | 130 | 11.5 |
| 55 | Compound 14 | 0.001 | 135 | 11.5 |
| 56 | Compound 14 | 0.002 | 126 | 12.5 |
| 57 | Compound 25 | 0.002 | 115 | 11.0 |
| 58 | Comparative Compound I | 0.002 | 150 | 5.5 |

The comparative compound used herein is illustrated below.

Comparative Compound I $$HO-CH_2-CH_2-S-CH_2CH_2-S-CH_2-CH_2-OH$$

While the invention has been described in detail and with reference to specific embodiments thereof, it will be apparent to one skilled in the art that various changes and modifications can be made therein without departing from the spirit and scope thereof.

What is claimed is:

1. An image forming method comprising developing a silver halide photographic material in the presence of a compound represented by the following general formula (I) or the salt thereof:

$$R^1-S-A-N\begin{matrix}R^2\\R^3\end{matrix} \quad (I)$$

wherein $R^1$ represents an alkyl group, an aryl group, an aralkyl group or a cycloalkyl group; $R^2$ and $R^3$, which may be the same or different, each represents a hydrogen atom, a substituted or unsubstituted alkyl group, a substituted or unsubstituted alkenyl group, a substituted or unsubstituted aryl group a substituted or unsubstituted aralkyl group, or a substituted or unsubstituted alkylcarbonyl group in which the substituent is a halogen atom, a cyano group, a nitro group, a hydroxyl group, a carboxyl group, a sulfo group, an alkyl group, an aryl group, an alkoxy group, an aryloxy group, an acyloxy group, an acylamino group, a sulfonamido group, a sulfamoyl group, a carbamoyl group, an alkoxycarbonyl group, a sulfonyl group, a sulfinyl group or an alkylthio group, or $R^2$ and $R^3$ may combine with each other and form a ring; and A represents a divalent linking group.

2. An image forming method as claimed in claim 1, wherein $R^1$ which may be substituted or unsubstituted, represents an aryl group having not more than 20 carbon atoms, an aralkyl group having not more than 16 carbon atoms, an alkyl group having from 1 to 16 carbon atoms, and a cycloalkyl group having not more than 10 carbon atoms.

3. An image forming method as claimed in claim 1, wherein $R^1$ represents an aryl group or an aralkyl group, both of which may be unsubstituted or substituted by halogen atoms, cyano groups, and lower alkyl groups.

4. An image forming method as claimed in claim 1, wherein $R^2$ and $R^3$, which may be the same or different, represent a hydrogen atom, an alkyl group having 1 to 12 carbon atoms, an alkenyl group having up to 12 carbon atoms, an aryl group having up to 20 carbon atoms, an aralkyl group having up to 16 carbon atoms, and an alkylcarbonyl group having up to 12 carbon atoms.

5. An image forming method as claimed in claim 1, wherein at least one of $R^2$ or $R^3$ is a hydrogen atom.

6. An image forming method as claimed in claim 1, wherein both $R^2$ and $R^3$ represent a hydrogen atom.

7. An image forming method as claimed in claim 1, wherein A is a straight or branched chain alkylene group having not more than 12 carbon atoms.

8. An image forming method as claimed in claim 1, wherein the compound represented by the general formula (I) is a salt with an inorganic or an organic acid.

9. An image forming method as claimed in claim 8, wherein the inorganic acid is hydrochloric acid, sulfuric acid, nitric acid, hydrobromic acid, or perchloric acid.

10. An image forming method as claimed in claim 8, wherein the organic acid is acetic acid, oxalic acid malonic acid, maleic acid, fumaric acid, malic acid, or p-toluenesulfonic acid.

11. An image forming method as claimed in claim 1, wherein the compound of the general formula (I) is incorporated into a silver halide photographic emulsion layer.

12. An image forming method as claimed in claim 11, wherein the compound of the general formula (I) is present in an amount ranging from about $1\times10^{-5}$ to about $5\times10^{-2}$ mol/mol of silver halide.

13. An image forming method as claimed in claim 12, wherein the compound of the general formula (I) is present in an amount ranging from $5\times10^{-5}$ to $2\times10^{-2}$ mol/mol of silver halide.

14. An image forming method as claimed in claim 1, wherein the compound of the general formula (I) is contained in a processing solution.

15. An image forming method as claimed in claim 14, wherein the compound of the general formula (I) is present in an amount of about $1\times10^{-4}$ to about $5\times10^{-2}$ mol/l.

16. An image forming method as claimed in claim 15, wherein the compound of the general formula (I) is present in an amount of $2\times10^{-4}$ to $2\times10^{-2}$ mol/l.

17. An image forming method as claimed in claim 1, wherein $R^1$ represents a substituted or unsubstituted aryl group or a substituted or unsubstituted aralkyl group.

18. An image forming method as claimed in claim 1, wherein $R^1$ represents a substituted or unsubstituted alkyl group, a substituted or unsubstituted aryl group, a substituted or unsubstituted aralkyl group or a substituted or unsubstituted cycloalkyl group, in which the substituent is a halogen atom, a cyano group, a nitro group, a hydroxyl group, a carboxyl group, a sulfo group, an alkyl group, an aryl group, an alkoxy group, an aryloxy group, an acyloxy group, an acylamino group, a sulfonamido group, a sulfamoyl group, a carbamoyl group, an alkoxycarbonyl group, a sulfonyl group, a sulfinyl group or an alkylthio group.

19. An image forming method as claimed in claim 1, wherein $R^2$ and $R^3$, which may be the same or different, each represents a hydrogen atom, a substituted or unsubstituted alkyl group, a substituted or unsubstituted alkenyl group, a substituted or unsubstituted aryl group a substituted or unsubstituted aralkyl group, or a substituted or unsubstituted alkylcarbonyl group.

* * * * *